US007804389B2

(12) United States Patent
Kim et al.

(10) Patent No.: US 7,804,389 B2
(45) Date of Patent: Sep. 28, 2010

(54) CHIP-TYPE INDUCTOR

(75) Inventors: Sung Il Kim, Gyeonggi-do (KR); Il Je Cho, Gyeonggi-do (KR); Jae Hyun Uhm, Gyeongsangbuk-do (KR); Du Il Kim, Gyeonggi do (KR); Jong Go Seo, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 609 days.

(21) Appl. No.: 11/646,332

(22) Filed: Dec. 28, 2006

(65) Prior Publication Data

US 2007/0152793 A1 Jul. 5, 2007

(30) Foreign Application Priority Data

Dec. 29, 2005 (KR) ..... 10-2005-0133916
Jan. 12, 2006 (KR) ..... 10-2006-0003576

(51) Int. Cl.
*H01F 5/00* (2006.01)
*H01F 27/02* (2006.01)
*H01F 27/28* (2006.01)
*H01F 7/06* (2006.01)

(52) U.S. Cl. ..... 336/200; 336/83; 336/195; 336/223; 336/232; 29/602.1

(58) Field of Classification Search ..... 29/602.1; 336/83, 200, 223, 232
See application file for complete search history.

(56) References Cited

U.S. PATENT DOCUMENTS 7,069,639 B2 * 7/2006 Choi et al. ..... 29/602.1

FOREIGN PATENT DOCUMENTS

CN 1505068 6/2004
JP 2000151325 A * 5/2000

OTHER PUBLICATIONS

Chinese Office Action dated Jul. 15, 2009.

* cited by examiner

*Primary Examiner*—Elvin G Enad
*Assistant Examiner*—Ronald W Hinson
(74) *Attorney, Agent, or Firm*—KED & Associates LLP

(57) ABSTRACT

A chip-type inductor comprising includes internal magnetic material, external magnetic material disposed on opposing sides of the internal magnetic material, and a conductor formed in a space between the internal and external magnetic material. The internal and external magnetic materials form a magnetic path along which magnetic flux of a magnetic field produced by current flowing along the conductor flows. According to at least one embodiment, the flow cross-sectional area of the magnetic flux in the internal magnetic material is at least substantially equal to a sum of the flow cross-sectional areas in the external magnetic materials.

21 Claims, 12 Drawing Sheets

| Energy | Bias Current | Inductance |
|---|---|---|
| 2.88E-11 | 0.01 | 5.76E-07 |
| 1.18E-10 | 0.02 | 5.90E-07 |
| 2.55E-10 | 0.03 | 5.67E-07 |
| 1.03E-09 | 0.05 | 8.24E-07 |
| 1.38E-09 | 0.07 | 5.63E-07 |
| 4.30E-09 | 0.1 | 8.60E-07 |
| 1.90E-08 | 0.2 | 9.50E-07 |
| 4.72E-08 | 0.3 | 1.05E-06 |
| 1.67E-07 | 0.5 | 1.34E-06 |
| 3.87E-07 | 0.7 | 1.58E-06 |
| 6.73E-07 | 1 | 1.35E-06 |
| 1.26E-06 | 1.2 | 1.75E-06 |
| 1.37E-06 | 1.5 | 1.22E-06 |
| 2.31E-06 | 1.7 | 1.60E-06 |
| 2.80E-06 | 2 | 1.40E-06 |
| 3.02E-06 | 2.5 | 9.66E-07 |
| 4.76E-06 | 3 | 1.06E-06 |
| 5.73E-06 | 3.5 | 9.36E-07 |
| 6.64E-06 | 4 | 8.30E-07 |
| 7.02E-07 | 5 | 5.62E-08 |

| Energy | Bias Current | Inductance |
|---|---|---|
| 2.50E-11 | 0.01 | 5.00E-07 |
| 1.00E-10 | 0.02 | 5.00E-07 |
| 6.34E-10 | 0.05 | 5.07E-07 |
| 2.58E-09 | 0.1 | 5.16E-07 |
| 1.10E-08 | 0.2 | 5.50E-07 |
| 2.60E-08 | 0.3 | 5.78E-07 |
| 8.40E-08 | 0.5 | 6.72E-07 |
| 1.88E-07 | 0.7 | 7.67E-07 |
| 4.32E-07 | 1 | 8.64E-07 |
| 6.52E-07 | 1.2 | 9.06E-07 |
| 1.05E-06 | 1.5 | 9.33E-07 |
| 1.88E-06 | 2 | 9.40E-07 |
| 2.73E-06 | 2.5 | 8.74E-07 |
| 3.54E-06 | 3 | 7.87E-07 |
| 5.13E-06 | 4 | 6.41E-07 |
| 6.84E-06 | 5 | 5.47E-07 |

CHIP-TYPE INDUCTOR

BACKGROUND

1. Field

One or more embodiments discussed herein relate to an inductor.

2. Background

Because of inadequate magnetic force characteristics, chip-type inductors have only been used for low-current applications. These applications include serving as filters or performing one or more signal-control functions. Chip-type inductors have also demonstrated poor heat release characteristics which degrade performance.

BRIEF DESCRIPTION OF THE DRAWINGS

The embodiments will be described in detail with reference to the following drawings, in which like reference numerals refer to like elements.

DETAILED DESCRIPTION

Figure 10:
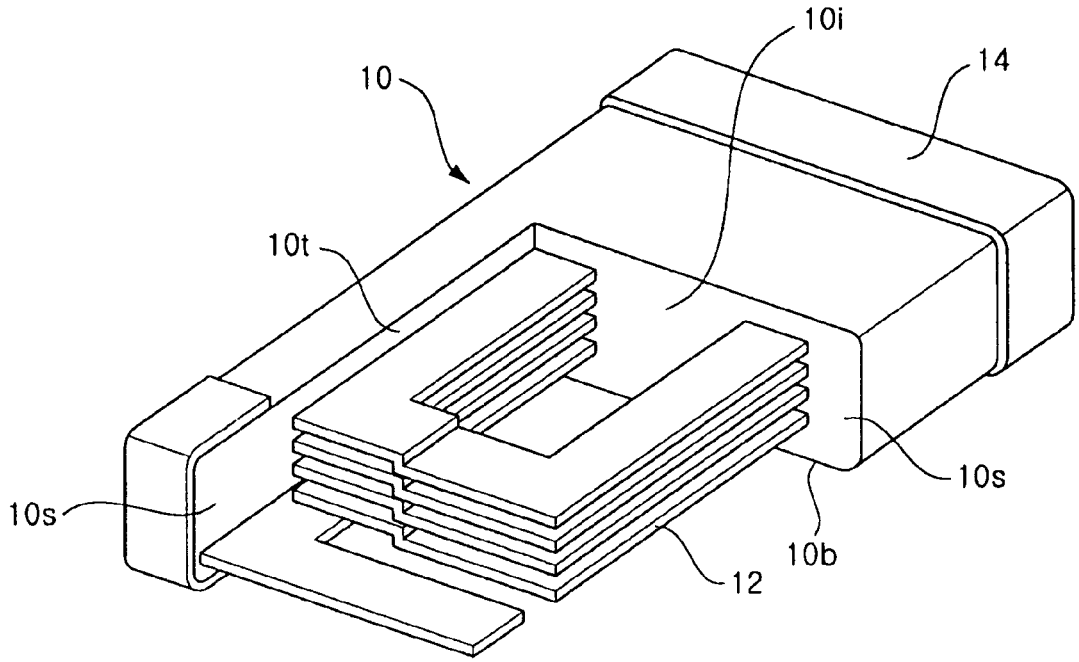
FIG. 10 is a diagram showing another chip-type inductor.
Figure 11:
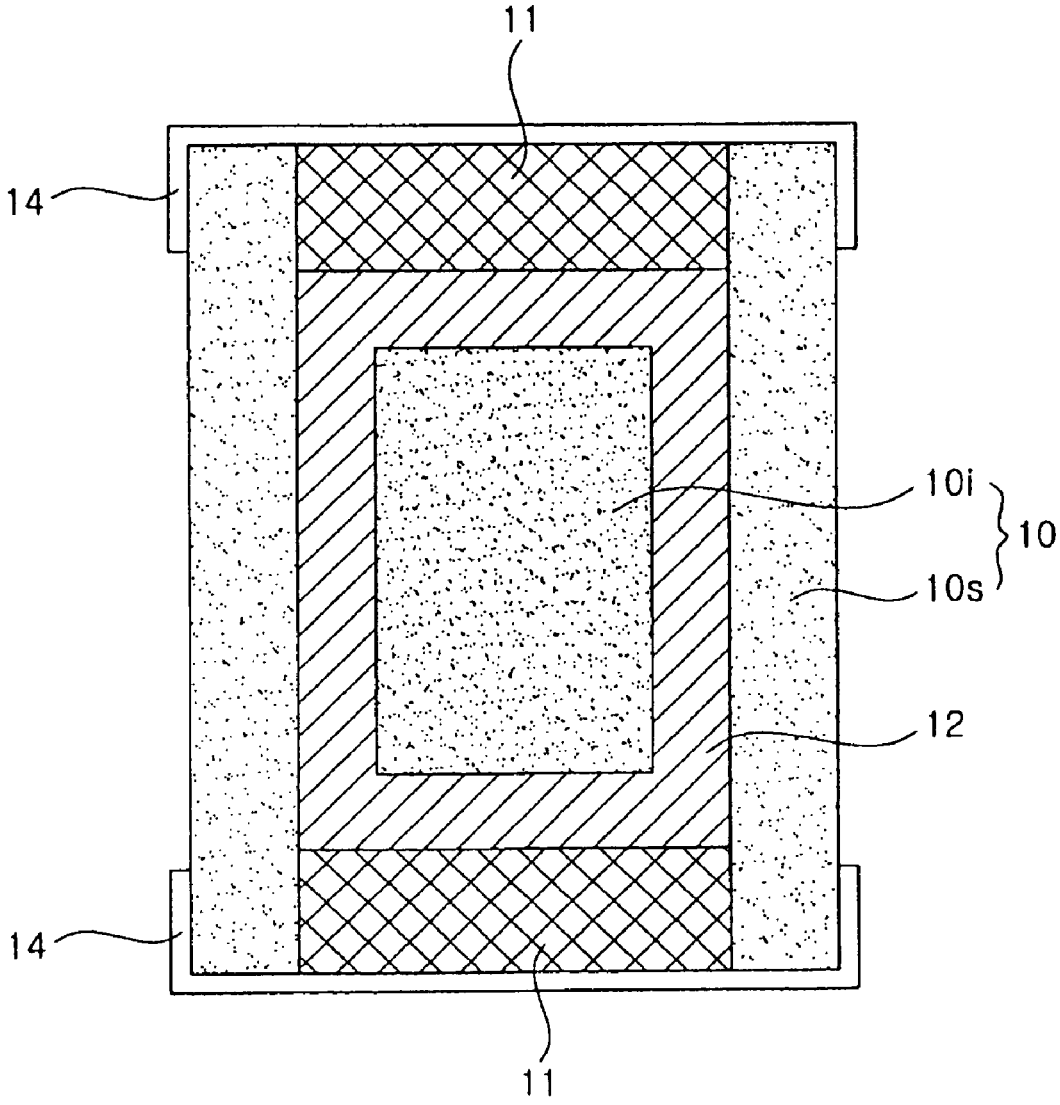
FIG. 11 is a diagram showing another view of the inductor of FIG. 10.

FIGS. 10 and 11 show one type of chip-type inductor that includes a conductive pattern 12 formed on a non-magnetic material 11, where the non-magnetic material is provided within a magnetic material body 10. The magnetic material body may consist of an internal magnetic material 10*i*, an external magnetic material 10*s* provided at opposite sides of inner magnetic material 10*i*, a top magnetic material 10*t*, and a bottom magnetic material 10*b* provided at the top and bottom parts of the inductor. The magnetic material body 10 is formed in a single body by stacking a plurality of magnetic material sheets and then firing the sheets to integrate them together.

In the aforementioned inductor, conductive pattern 12 is provided in the non-magnetic material 11 forming the remaining part of the inductor except the magnetic material body 10. Conductive pattern 12 is provided in multi-layered form and is formed by stacking a plurality of non-magnetic material layers, each of which has a conductive pattern 12 formed on a surface thereof.

A plurality of conductive patterns in such a multi-layered conductive pattern is formed by continuously interconnecting a conductive pattern provided on one non-magnetic material layer with another conductive pattern 12 provided on another non-magnetic material layer just below the one non-magnetic material layer. Opposing ends of multi-layered conductive pattern 12 are then electrically connected with outer electrodes 14 through opposite ends of the magnetic material body 10, respectively.

With the inductor configured as described above, if electric current flows along conductive pattern 12, magnetic fields are produced around the multi-layered conductive pattern. These magnetic fields overlap, and as a result magnetic flux is increased with a high magnetic permeability, to allow more energy to be stored within the magnetic material body.

However, the chip-type inductive of FIGS. 10 and 11 have problems. First, there is a difference in flow cross-section area, through which the magnetic flux flows, between the internal magnetic material 10*i* and the external magnetic material 10*s*. As a result, the flow of magnetic flux is not smooth and, therefore, a reduction in an inductance value of the inductor is realized.

Also, due to the structure of the internal magnetic material 10*i*, the intensity of magnetic flux flowing toward the non-magnetic material 11, rather than toward the external magnetic material 10*s*, is relatively weak. As a result, it is impossible to obtain a higher inductance value.

In addition, in the inductor of FIGS. 10 and 11, magnetic material body 10 loses its nature as being saturated, even by a low level of current, due to its structural characteristics. Therefore, the inductor is relegated to operate with a relatively low level of saturation current. For this reason, the inductor cannot be employed as a power inductor which requires a high level of available current. Rather, the inductor can be employed merely as a filter or an inductor for controlling signals.

Figure 12:
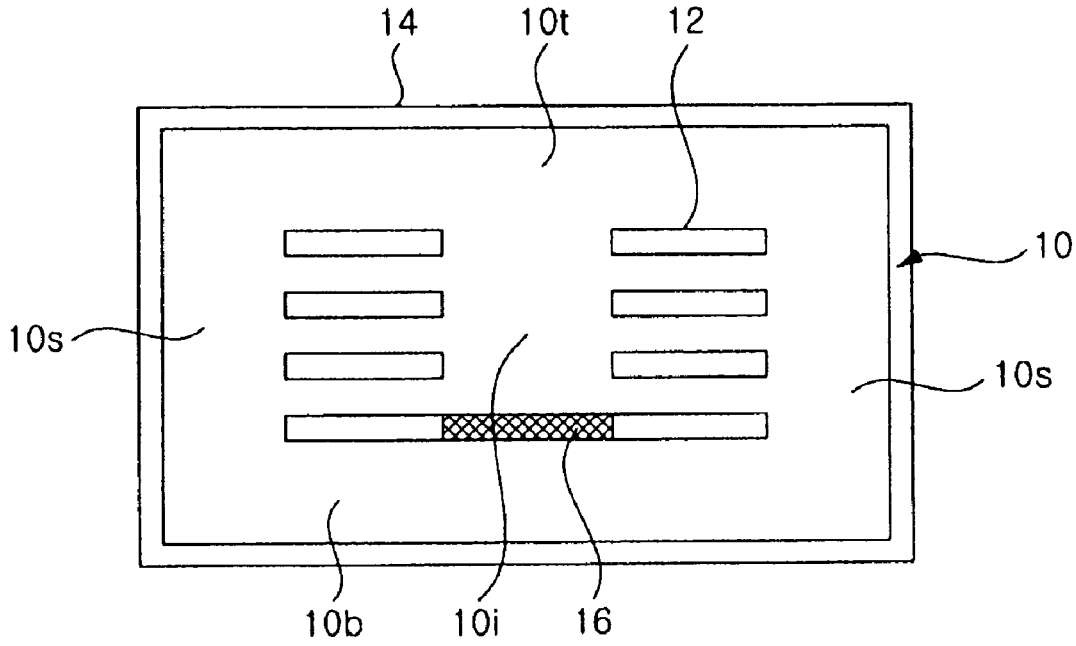
FIG. 12 is a diagram showing a chip-type inductor having a gap.

In order to avoid the above-mentioned problems, it is possible to prevent the saturation of current by providing a gap 16 in the internal magnetic material 10*i* of the magnetic material body 10, as shown in FIG. 12. This gap may disturb the flow of magnet flux, to a certain extent, at a place where internal magnetic material 10*i* forms a magnetic path. However, internal magnetic material 10*i* serves as an engine for forwarding magnetic flux to the entire magnetic material body 10. Thus, if gap 16 is formed in a part which serves as an engine part, the production of magnetic fields is disturbed such that the extent of producing magnetic flux can be deteriorated.

In addition, significant heat is produced from conductive pattern 12 while the inductor is working. However, since conductive pattern 12 is entirely enclosed by magnetic material body 10, heat release performance is poor. And, as the inductor heats to a high temperature, the working characteristics of the inductor may deteriorate.

Figure 1:
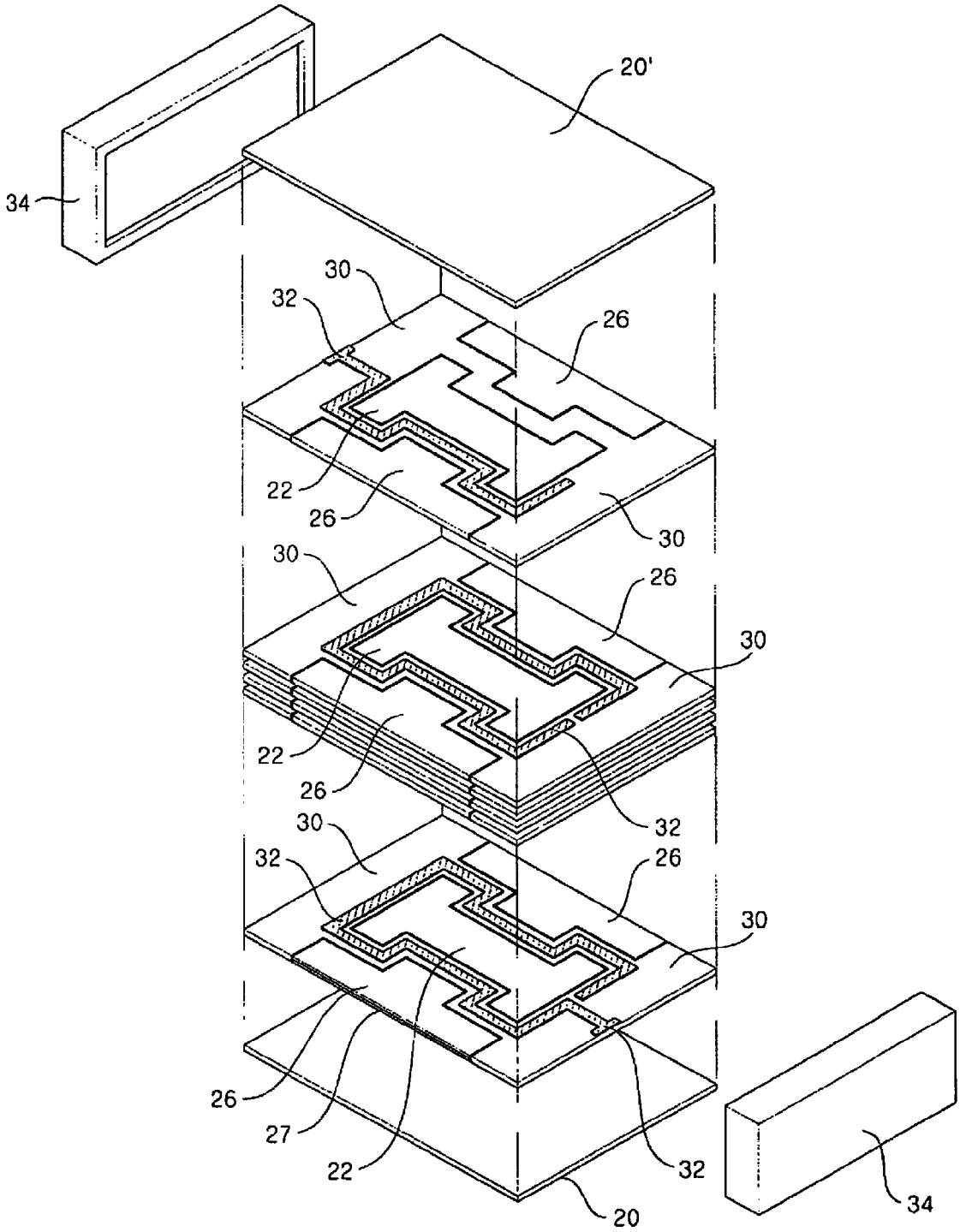
FIG. 1 is a diagram showing a perspective view of one embodiment of a chip-type inductor.
Figure 2:
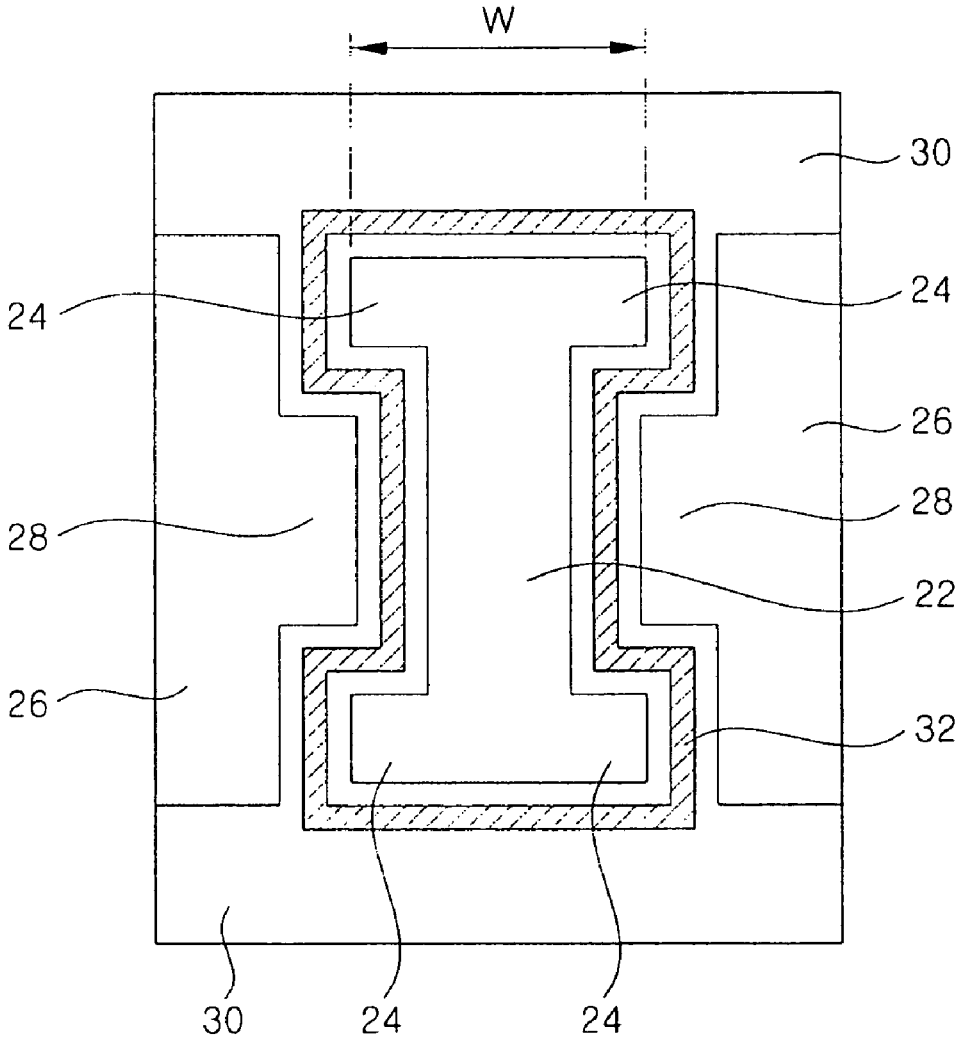
FIG. 2 is a diagram showing one sheet of the inductor in FIG. 1.
Figure 3:
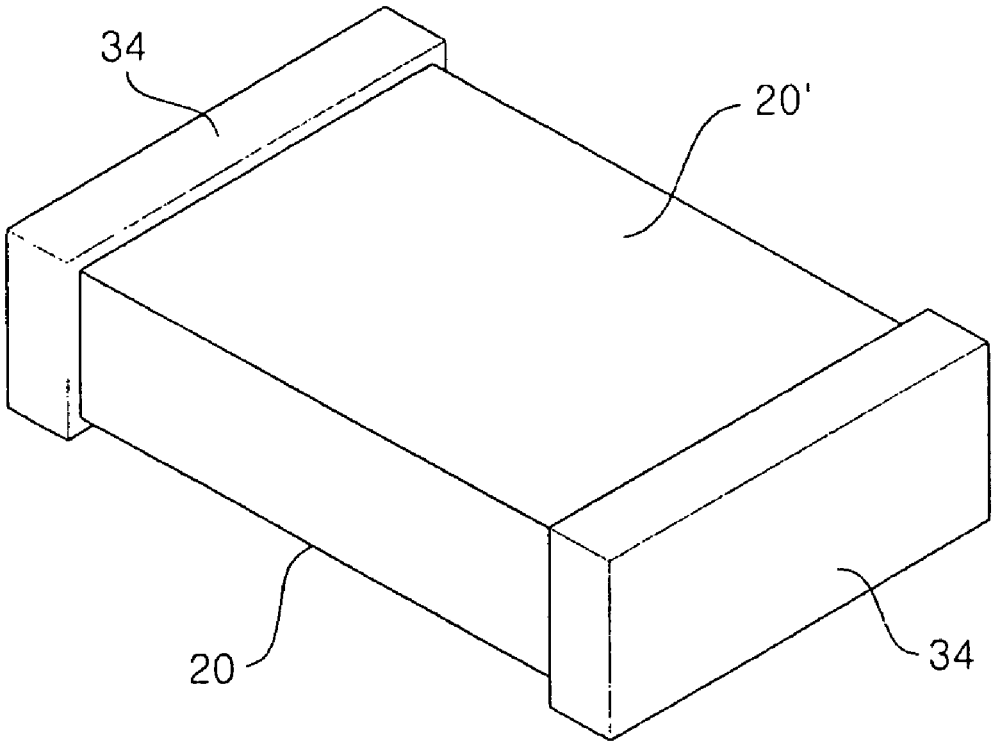
FIG. 3 is a diagram showing another view of the inductor of FIG. 1.

Referring to FIGS. 1 to 3, another chip-type inductor is shown as having a substantially hexahedron shape where a substantially rectangular plate-shaped bottom magnetic material 20 and a substantially rectangular plate0shaped top magnetic material 20' form top and bottom parts of the inductor. (The bottom magnetic material and the top magnetic material are not configured to be separated from an external magnetic material 26 and a non-magnetic material 30. FIG. 1 shows the above-mentioned magnetic and non-magnetic materials in a separated condition merely for the purpose of convenient description. In fact, the above-mentioned materials are fired, thereby being formed in a single body.)

The internal magnetic material 22, outer magnetic material 26, and non-magnetic material 30 are provided between the bottom and top magnetic materials 20 and 20', and a conductive pattern 32 is provided in or on non-magnetic material 30. During the manufacturing process, internal magnetic material 22, external magnetic material 26, and non-magnetic material 30 may be formed into a single layer of a rectangular-shaped sheet having an area which corresponds to bottom and top magnetic materials 20 and 20'.

In other words, a sheet, in which internal magnetic material 22 and two external magnetic materials 26 are defined and cut, and a sheet of non-magnetic material 30 formed with a conductive pattern 32, cooperate to form a single flat layer. Thus, each of the sheets include internal magnetic material 22, two external magnetic materials 26 and non-magnetic material 30, as shown in FIG. 1. The sheets are then stacked to a predetermined thickness and integrated when the inductor is completed, so that no boundaries are formed between them.

The flow cross-section area for magnetic flux in internal magnetic material 22 flow (i.e., the cross-sectional area of a plane crossing the flowing direction of the magnetic flux between the top and bottom magnetic materials 20 and 20') may be equal to a sum of the flow cross-sectional areas for magnetic flux in external magnetic materials 26. In accordance with one embodiment, the flow cross-sectional area of internal magnetic material 22 may be two or more times as large as the flow cross-sectional area of any one of external magnetic materials 26.

With this structure, the flow of magnetic flux can be smoothly executed in the order of the internal magnetic material 22, top magnetic material 20', external magnetic materials 26, and bottom magnetic material 20, or vise versa. This is because the cross-sectional area, through which the magnetic flux flows, can be uniformly retained without being changed. For this purpose, the thickness of the bottom and top magnetic materials 20 and 20' may be designed in such a way that the flow cross-sectional area for magnetic flux in each of the bottom and top magnetic materials may be equal to the flow cross-sectional areas in external magnetic materials 26.

As shown in FIG. 2, internal magnetic material 22 may be formed in a predetermined shape (e.g., in the shape of an "I") when viewed in a top plan view. The internal magnetic material 22 may be formed with internal projections 24 at opposite ends thereof. Because internal projections 24 extend laterally from opposing sides of each end of internal magnetic material 22, the parts of internal magnetic material 22 opposing non-magnetic material 30 may have relatively long width W.

In order to more efficiently use the space between internal magnetic material 22 and external materials 26 in a state where internal projections 34 are formed at opposite ends of internal magnetic material 22, external magnetic materials 26 may be formed with external projections 28 at middle areas of the lateral sides thereof opposing the internal magnetic material 22. The external projections 28 allow magnetic materials 22 and 26 to be more efficiently arranged within the inductor, while rendering the space between internal magnetic material 22 and outer magnetic materials 26 to be entirely evenly formed.

The conductive pattern 32 formed in non-magnetic material 30 surrounds the internal magnetic material 22. In accordance with one embodiment, conductive pattern 32 may be formed in the following manner. Each of magnetic and non-magnetic sheet-like layers prior to forming a single magnetic material body as mentioned above is provided with one conductive pattern. A conductive pattern on one sheet-like layer and another conductive pattern on another sheet-like layer positioned just below the one sheet layer) are electrically interconnected with each other, so that all the conductive patterns are continuously interconnected in an approximately spiral form. As a result, single conductive pattern 32 in a resultant inductor is formed. The conductive pattern 32, thus, surrounds internal magnetic material 22 with a plurality of turns.

The opposite ends of conductive pattern 32 of the inductor are connected with external terminals 34, respectively. The shape of conductive patterns 32 (formed in sheet-like layers) and the connection of conductive patterns 32 with external terminals 34 may not necessarily be implemented as shown in FIG. 1. On the contrary, and various configurations and alternatives can be employed.

The external magnetic materials 26 are formed with a magnetic material gap 27 of a predetermined width in the magnetic flux advancement direction. The magnetic material gap 27 prevents the occurrence of magnetic saturation when magnetic flux flows through the external magnetic materials 26.

The magnetic material gap 27 may be formed by positioning a non-magnetic material on a part of one layer, or on one or more layers of external magnetic materials 26, when stacking the layers of the external magnetic materials 26. In one embodiment, a magnetic material gap 27 is shown as being formed at an area where external magnetic materials 26 and bottom magnetic material 20 are interconnected. In alternative embodiments, the magnetic material gap may be formed on any side of the external magnetic materials or at an area where external magnetic materials 26 are connected with top magnetic material 20'.

In addition, in order to design an inductor to obtain a different inductance value, it is possible either to provide only one of the external magnetic materials 26 with such a magnetic material gap 27, or to provide all or fewer than all of the external magnetic materials 26 with such a magnetic material gap 27. In this case, external magnetic materials 26 may be arranged to be laterally opposed to opposing lateral sides of internal magnetic material 22, respectively, as shown in the drawings. Of course, it is also possible to tune preventing the occurrence of magnetic saturation by adjusting the dimension of the magnetic material gap(s) 27.

As shown in FIG. 3, external terminals 34 are provided at the external opposite ends of the inductor, respectively. The external terminals are electrically connected with opposite ends of conductive pattern 32. The external terminals may be formed to cover the entirety of the opposite end surfaces of the inductor formed in a hexahedron shape or another shape.

Figure 4:
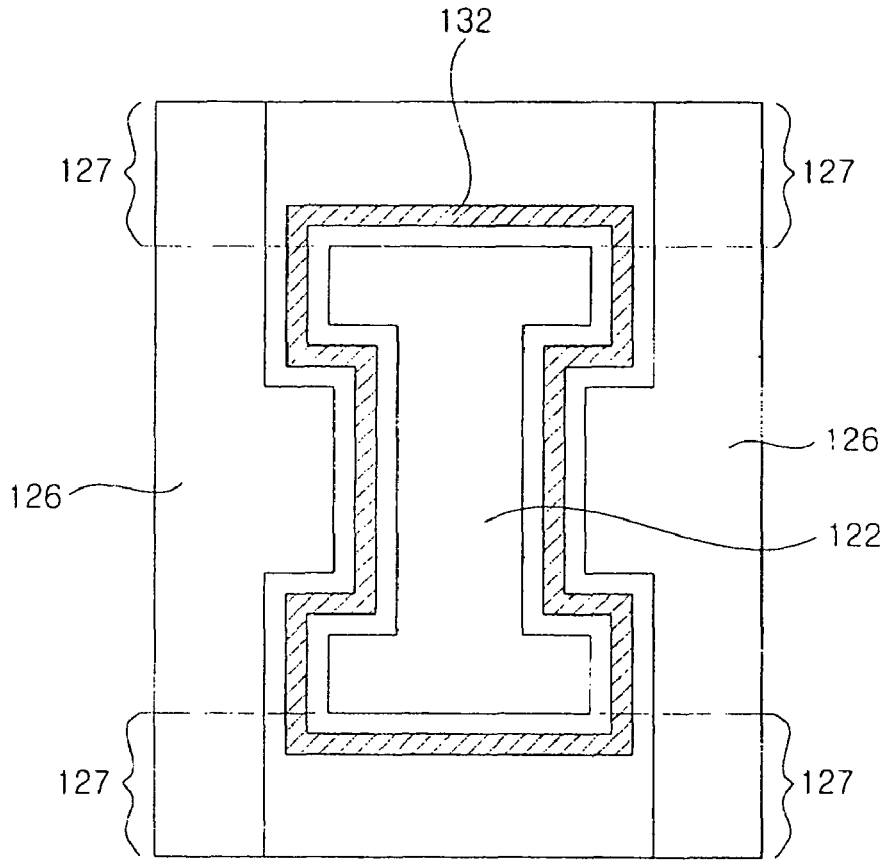
FIG. 4 is a diagram showing another embodiment of a chip-type inductor.
Figure 5:
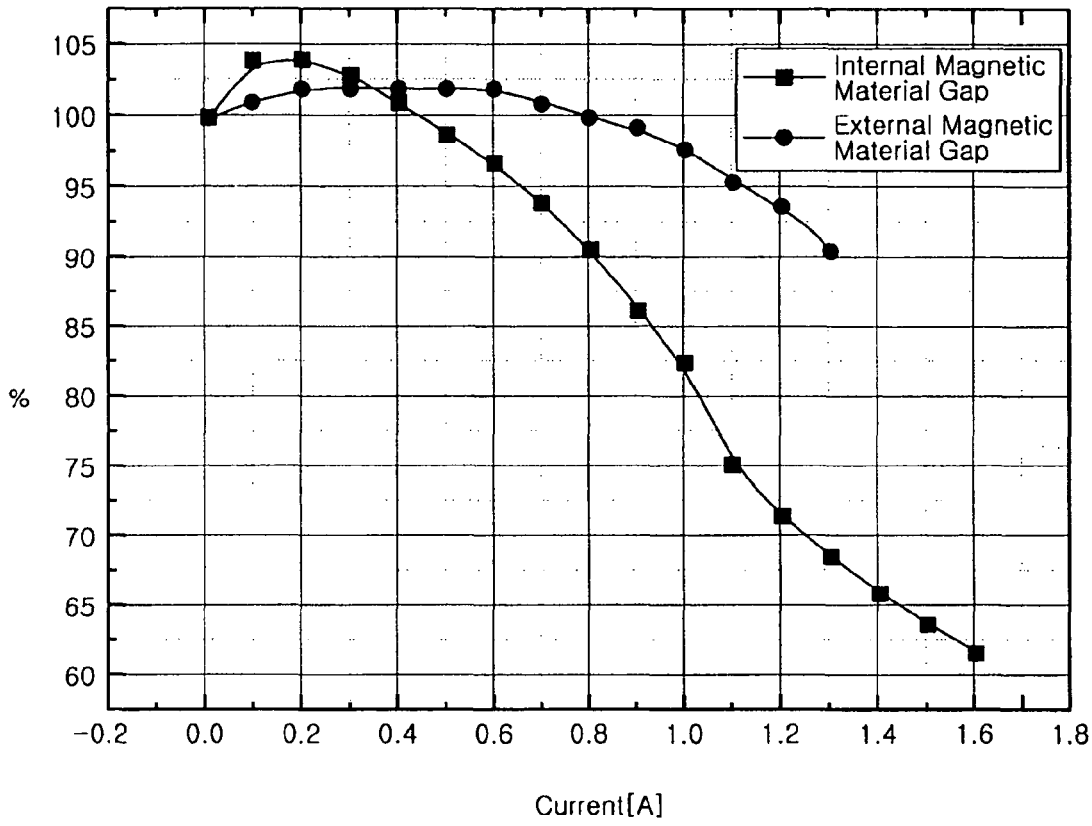
FIG. 5 is a graph showing an example characteristic which may be obtained by forming a gap in an external magnetic material according to one or more of the aforementioned embodiments.

FIG. 4 shows another chip-type inductor where only parts that are different from those of the previous inductor will be described for convenience. In the embodiment of FIG. 4, extensions 127 are formed at opposing ends of each of the external magnetic materials 126. The extensions may extend beyond opposing ends of internal magnetic material 122. As such, the absolute flux cross-sectional area for magnetic flux in the external magnetic materials 126 can be increased. Because the absolute area is increased in this manner, the inductance value to be obtained can be further increased.

For reference, the relationship between the absolute area for the magnetic flux and inductance may be defined as the following equation:

$$L = \frac{A_e A_{cw} B J K_f}{I_p I_s}$$

In the equation, $A_e$ is a cross-section area of a magnetic material, $A_{cw}$ is a spatial area between magnetic materials provided so as to allow a conductive line to pass, L is an inductance, $I_p$ is a peak current, B is a magnetic flux density, J is a current density, and $K_f$ is a proportional constant.

As can be seen from the above equation, the cross-sectional area and the inductance of a magnetic material are proportional to each other. Therefore, if the absolute area of a magnetic material is increased, the inductance of the magnetic material is also increased. Of course, at this time, the ratio of the cross-sectional areas of internal magnetic material 122 and external magnetic materials 126 are preferably retained to be equal to that of the aforementioned embodiment.

Figure 7:
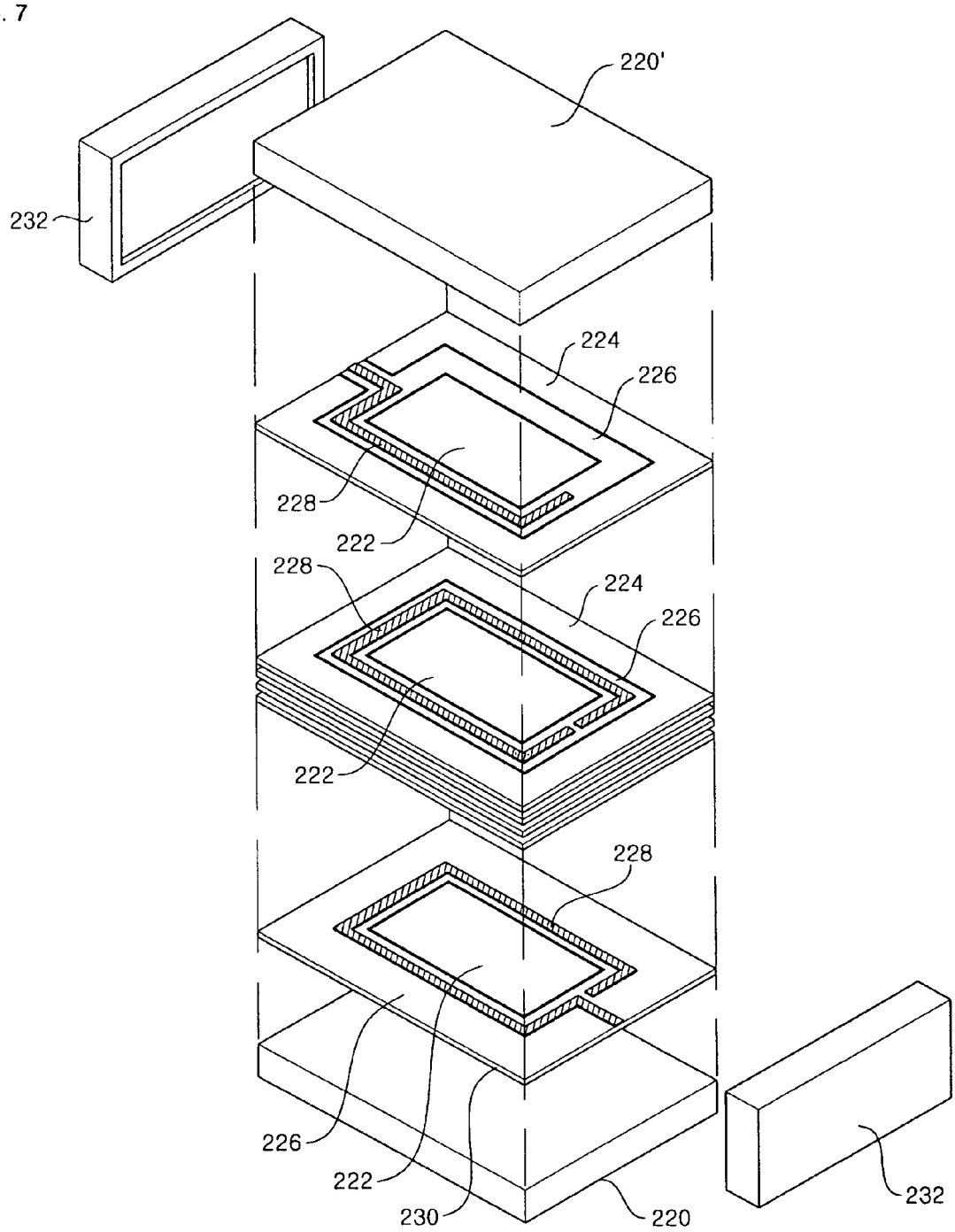
FIG. 7 is a diagram showing another embodiment of the chip-type inductor.
Figure 8:
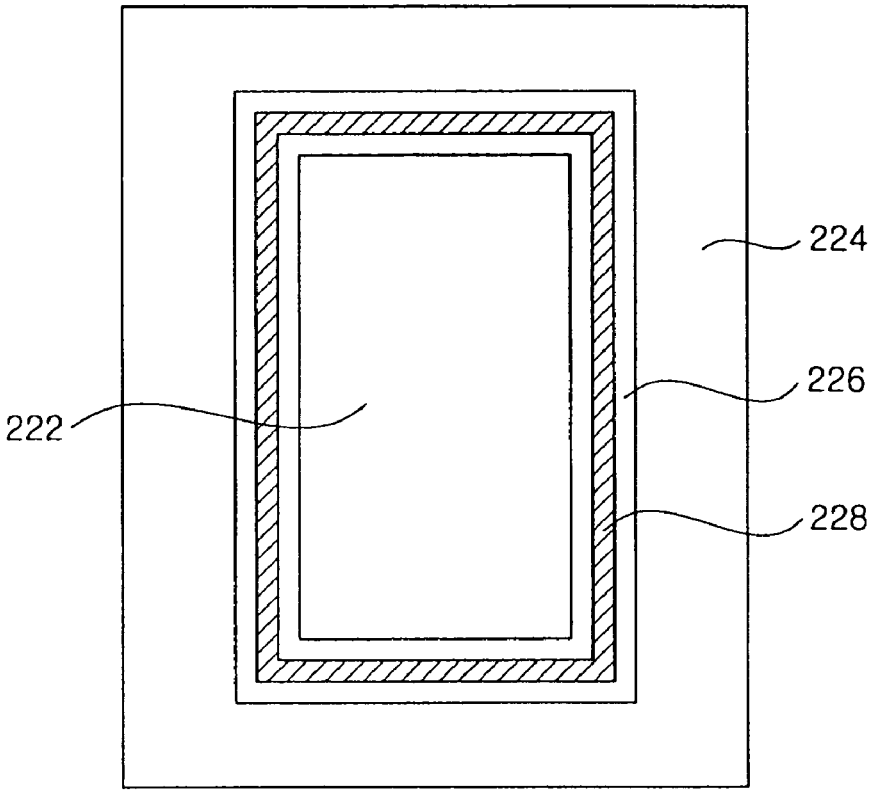
FIG. 8 is a diagram showing one sheet included in the inductor of FIG. 7.

FIG. 7 shows another chip-type inductor which is formed in a substantially hexahedron shape. In this inductor, a bottom magnetic material 220 and a top magnetic material 220', each of which is formed in a substantially rectangular plate, form the top and bottom parts of the inductor, respectively. (Of course, the bottom magnetic material 220 and the top magnetic material 220' are not formed to be separated from an internal magnetic material 222, external magnetic material 224, and non-magnetic material 226. The drawing shows them in a separated state for convenience of description. In fact, these components may be integrated, thereby forming a one-piece body.)

The internal magnetic material 222, external magnetic material 224, and non-magnetic material 226 are provided between bottom magnetic material 220 and top magnetic material. A conductive pattern 228 is formed on the non-magnetic material 224. In a practical manufacturing process, internal magnetic material 222, external magnetic material 224, and non-magnetic material 226, may form a single sheet-like layer of a rectangular shape having an area corresponding to that of the bottom and top magnetic materials 220 and 220'. More specifically, a layer with internal magnetic material 222 and external magnetic material, which are cut to be separated from each other, and a layer formed with a conductive pattern 228 form a single sheet-like layer.

As further shown in FIG. 7, a plurality of sheet-like layers each formed with internal magnetic material 222, external magnetic material 224, and non-magnetic material 226, are stacked to a predetermined thickness and integrated so that no boundary is formed between the sheet-like layers when an inductor is completed.

The internal magnetic material 222 has a rectangular shape when shown in a top plan view, and the external magnetic material 224 is formed in a shape surrounding the internal magnetic material 222. In addition, non-magnetic material 226 is arranged between the external edges of internal magnetic material 222 and the internal edges of external magnetic material 224. When the internal magnetic material 222 and the external magnetic material 224 are shown in a top plan view, a predetermined space is formed between the external edges of the internal magnetic material 222 and the internal edges of the external magnetic material 224.

Here, the flow cross-sectional area for magnetic flux in the internal magnetic material 222 may be equal to the entire flow cross-sectional area for magnetic flux in the external magnetic material 224. As such, the flow of magnetic flux can be smoothly executed. For example, the magnetic flux may be formed in the order of the internal magnetic material 222, top magnetic material 220', external magnetic material 224, and bottom magnetic material 220, or vise versa. This is because the flow cross-sectional area for magnetic flux may be uniformly retained without any change. For this purpose, the thickness of bottom and top magnetic materials 220 and 220' may be designed in such a manner that the flow cross-sectional area in each of the top and bottom magnetic areas is the same with that of the external magnetic material 226.

The conductive pattern 228 may be formed on the non-magnetic material 226 so as to surround the internal magnetic material 222. In other words, the conductive pattern 228 may be formed in a shape that corresponds to non-magnetic material 226.

The conductive pattern 228 may be formed in the following manner: each of the sheet-like layers formed by internal magnetic material 222, external magnetic material 224, and non-magnetic material 226 prior to forming a single body, is provided with such a conductive pattern 228. A conductive pattern on one sheet-like layer is electrically connected with another conductive pattern formed on another sheet-like layer just below the one sheet-like layer. All the conductive patterns may therefore be continuously interconnected in an approximately spiral shape, thereby substantially forming a single conductive pattern 228 in a resultant inductor. The resultant pattern 228 thus surrounds the internal magnetic material 222 with a plurality of turns.

The opposite ends of conductive pattern 228 are connected to external terminals 232 to be described later. Of course, it is not necessary to form the conductive patterns and the connection of the conductive patterns with the external terminals 232 as shown in the drawing. Various configurations and alternatives can be employed.

Figure 9:
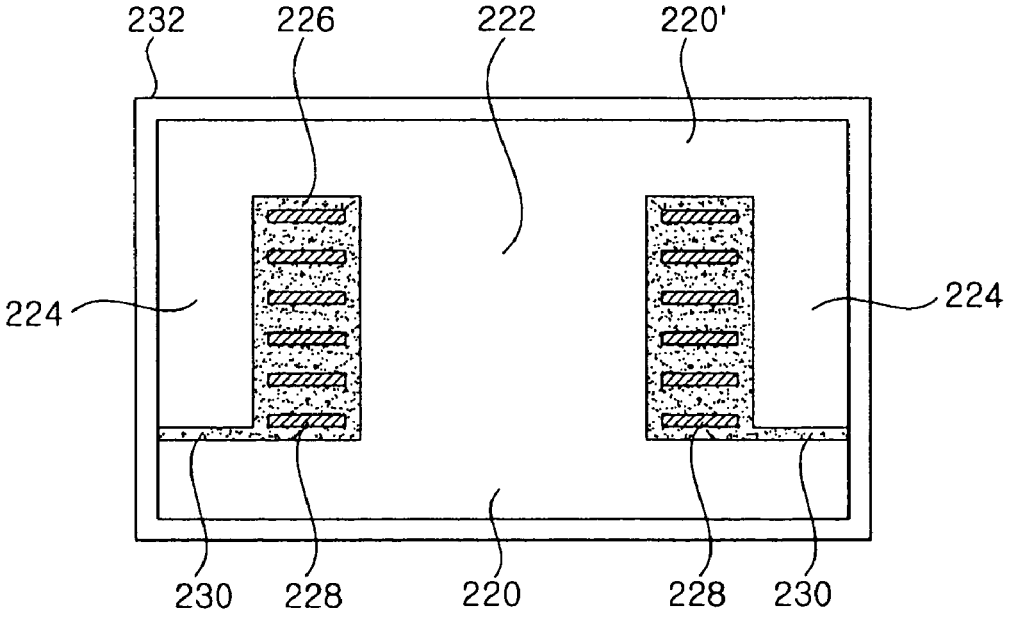
FIG. 9 is a diagram showing a sectioned view of the inductor of FIG. 7.

One or more magnetic material gaps 230 may be formed in the external magnetic material 224 in a predetermined width in the magnetic flux advancement direction. As shown in FIG. 9, the magnetic material gaps 230 prevent the occurrence of magnetic saturation when magnetic flux flows through external magnetic material 224. Such a magnetic material gap 230 may be formed by providing a non-magnetic material on a part of one layer of the external magnetic material 224, or one or more layers of the external magnetic material 224, when stacking the layers of the external magnetic material 224. In the layer formed with such a magnetic material gap 230, a non-magnetic material may therefore be provided at a position assigned to the external magnetic material 224. Consequently, the corresponding layer is formed by the non-magnetic material 226 except for one or more areas formed by the internal magnetic material 222.

In the aforementioned embodiment, magnetic material gaps 230 are shown as being formed at areas where the external magnetic material 224 and the bottom magnetic material 220 are connected with each other. However, it is possible to form such a magnetic material gap 230 at any lateral side of the external magnetic material 224 or at an area where the external magnetic material 224 and the top magnetic material 220' are connected with each other. In addition, in order to obtain a different inductance value, it is possible to form the magnetic material gap at one side (i.e., at any one side of the external magnetic material 224) corresponding to any one of the four sides of internal magnetic material 222. Further, the ability to prevent the occurrence of magnetic saturation may be tuned by adjusting the width of the magnetic material gap 230.

The opposite ends of the inductor may be provided with external terminals 232, respectively, and the external terminals 232 may be electrically connected with the opposite ends of the conductive pattern 228, respectively. Also, the external terminals 232 may be formed on the entirety of the opposite end surfaces of the inductor formed in a hexahedron shape.

Operation of the embodiments of the chip-type inductors shown in any one of FIGS. 1-9 will now be described.

Initially, the inductor is supplied with electricity as the external terminals 34 thereof are connected to the outside. If electricity is supplied to one of the external terminals 34 of the inductor, current flows along the conductive pattern 32 and a magnetic field is formed around the conductive pattern 32 by the current flowing through the conductive pattern 32. The magnetic flux of the magnetic field flow is formed, for example, in the order of the internal magnetic material 22, the top magnetic material 20', the external magnetic materials 26, and the bottom magnetic material 20 or vise versa, according to the direction of the current. In addition, the current will flow in the order of the internal magnetic material 22, the top magnetic material 20', the non-magnetic material 30, and the bottom magnetic material or vice versa.

Because the flow cross-sectional area to each of the external magnetic materials 26 is proportional to (e.g., half of) the internal magnetic material 22, the magnetic flux of the magnetic field produced by the current flowing along conductive pattern 32 between internal magnetic material 22 and external magnetic materials 26 can flow through the uniform flow cross-sectional area. Therefore, the magnetic flux of the magnetic field formed by the current flowing along the conductive pattern 32 can flow smoothly, and thus it is possible to obtain a relatively high inductance value.

Next, when designing the cross-sectional configuration of the internal magnetic material 22, internal projections 24 are formed at the opposite ends of the internal magnetic material 22. That is, the internal magnetic material 22 may take the form of an "I" shape when it is shown in a horizontally sectioned top plan view. As such, the width W of areas of the internal magnetic material 22 opposing non-magnetic material 30 is relatively increased.

The intensity of the magnetic flux passing through a magnetic path formed by non-magnetic material 30 is therefore relatively increased. At this time, focusing on the areas formed with the internal projections 24 in the internal magnetic material 22, it is determined that the value of $A_e$ is increased. Therefore, by applying the aforementioned equation, it can be found that the inductance is increased. That is, if the area of internal magnetic material 22 for transmitting magnetic flux to non-magnetic material 30 is relatively increased, the absolute cross-sectional area can also be increased, thereby increasing the inductance.

Meanwhile, as the internal projections 24 are formed at the opposite ends of the internal magnetic material 22, the space between the external magnetic materials and the internal magnetic material 22 can be varied. As such, the width of the non magnetic material 30 between the internal magnetic material 22 and the external magnetic materials 26 is increased, and the distance between the conductive pattern 32 and the internal magnetic material 22, and the distance between the conductive pattern 32 and the external magnetic materials 26 become different from each other. As such, a part of the magnetic field formed around the conductive pattern 32 may leak to the non-magnetic material 30.

In order to prevent this phenomenon, each of the external magnetic materials 26 may be formed with an external projection 28 at a side opposed to the internal magnetic material 22, so that the space between the external materials 26 and the internal magnetic material 22 is entirely even. As such, it is possible to maximize the areas of the internal magnetic material 22 and the external magnetic materials 26, and to efficiently arrange the magnetic materials 22 and 26 within an inductor.

In addition, a magnetic material gap 27 is formed on the external magnetic materials 27 to prevent the occurrence of magnetic saturation. By forming such a magnetic material gap 27 in the external magnetic materials 26, the inductor can exhibit a relatively superior characteristic. That is, the inductance is not dampened so greatly, whereas the direct current overlap characteristic can be greatly improved.

Figure 6A:
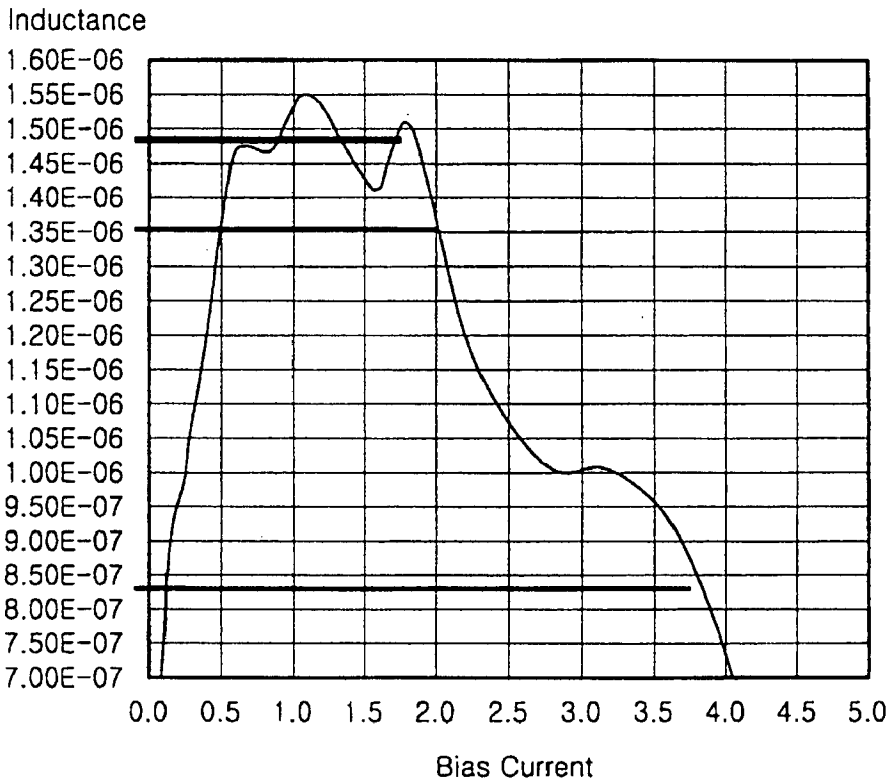
FIG. 6A is a table and graph showing an example of a relationship that may exist between inductance and bias current of a chip-type inductor according to one or more of the aforementioned embodiments.
Figure 6B:
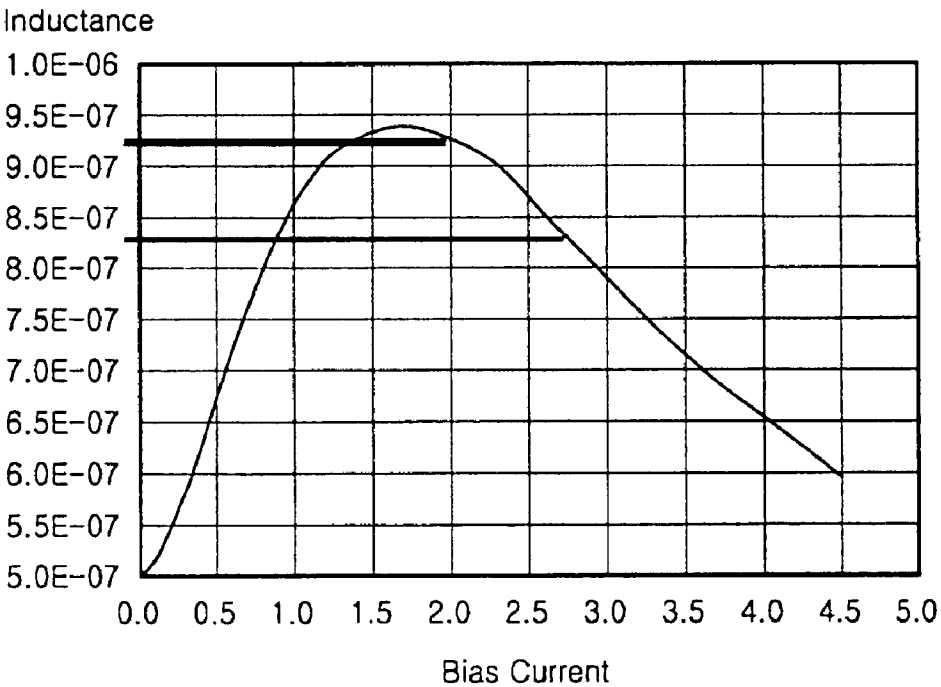
FIG. 6B is a table and graph showing a relationship between inductance and bias current of an inductor according to a comparative example.

For reference, FIGS. 6A and 6B show an example of results that may be obtained through a test performed by a comparison of the inductors of FIG. 1, 4, or 7 and the inductors of FIGS. 10-12, which is different in that the internal and external magnetic materials are not provided with internal and external projections. FIG. 6A shows the relationship between the values of inductance and bias current in the inductor of FIG. 1, 4 or 7, and FIG. 6B shows a relationship between the values of inductance and bias current in the inductor of FIG. 10-12.

In the example test provided in FIGS. 6A and 6B, the inductor of FIG. 1, 4 or 7 exhibit a current value about 40% higher than that of the inductor of FIGS. 10-12 at a same inductance value (on the basis of 0.83 A). For reference, the values of bias current are low in the first half of the test results due to a problem in evaluating the materials of the inductor. It is desirable to evaluate the decrease of inductance in percentage on the basis of the area adjacent to the peak value.

Meanwhile, the embodiment shown in FIG. 7 is supplied with electricity through the external terminals connected to the outside. If the electricity is supplied to one of the external terminal 232, current flows through the conductive pattern 228, and a magnetic field is formed around the conductive pattern 228 by the current flowing through the conductive pattern 228. The magnetic flux of the magnetic field flow in the order of the internal magnetic material 222, the top magnetic material 220', the external magnetic material 224, and the bottom magnetic material, or vice versa, according to the direction of the current.

In this process, since the cross-section area of one side of the external magnetic material 224 is half of that of the internal magnetic material 222, the magnetic flux of the magnetic field formed by the conductive pattern 228 between the internal magnetic material 222 and the external magnetic material 224 can flow through the uniform flow cross-section area. As a result, the magnetic fluxes of the magnetic field formed by the conductive pattern 228 can smoothly flow, whereby a relatively high inductance value can be obtained.

At this time, the magnetic material gap 230 of the external magnetic material 224 prevents the occurrence of magnetic saturation. By forming the magnetic material gap 230 in the external magnetic material 224, the inventive inductor exhibits a relatively superior characteristic. That is, the inductance is dampened not so greatly, whereas the direct current overlapping characteristic is greatly improved.

In particular, since the magnetic field produced by the conductive pattern 238 acts on the internal magnetic material 222, the internal magnetic material 222 serves as an engine for transmitting the magnetic field to the entire magnetic materials 222 and 224. Therefore, because no magnetic material gap 230 is formed in the internal magnetic material 222, the internal magnetic material 222 can more securely transmit the magnetic field to the external magnetic material 224, and the magnetic material gap 230 formed in the external magnetic material 224 prevents the occurrence of magnetic saturation. The results of testing the inventive inductor formed with the magnetic material gap 230 in comparison with a conventional inductor are not different from those shown in FIG. 5.

A chip-type inductor according to one or more of the aforementioned embodiments may therefore exhibit the following effects.

First, the flow cross-sectional area, through which magnetic flux flows, may be evenly formed in internal and external magnetic materials and in top and bottom magnetic materials. Therefore, magnetic flux smoothly flows through the entirety of the magnetic materials, whereby the inductance can be increased.

In particular, the amount of magnetic flux passing a non-magnetic material via bottom and top magnetic materials from an internal magnetic material is relatively increased. As the magnetic flux also pass the non-magnetic material in this manner, the magnetic flux is made to more smoothly flow, whereby the inductance can be increased.

In addition, a magnetic material gap is formed in a magnetic material, and in particular in an external magnetic material which forms a magnetic path through which magnetic flux flows, so as to prevent the occurrence of magnetic saturation. According to the results obtained through tests, a relatively high direct current overlapping characteristic can be obtained as compared with a comparative example with a gap formed in an internal magnetic material, whereby the characteristic of a resultant inductor can be improved.

Moreover, since a non-magnetic material is arranged to surround any one layer of an external magnetic material so as to form a magnetic material gap, heat produced from an internal conductive pattern can be relatively smoothly released through the non-magnetic material, whereby the operational characteristic of a resultant inductor can be further improved.

One or more embodiments described herein may therefore form a chip-type inductor which operates at a higher current and/or high inductance, and therefore may be suitable for use in one or more power applications. The inductor may also have improved working characteristics which prevent the magnetic material, which serves as a magnetic path allowing magnetic flux to flow, from being magnetically saturated. The inductor may further allow heat produced from an inductor to be smoothly released to the outside.

In accordance with one embodiment, the chip-type inductor comprises a magnetic material body comprising an internal magnetic material external magnetic materials arranged to be opposed to the opposite lateral sides of the internal magnetic material with a predetermined space, and bottom and top magnetic material provided at the top and bottom surfaces of the internal and external magnetic materials to be connected with the internal and external magnetic materials; a non-magnetic material filling the space between the internal and external magnetic materials in such a manner that the non-magnetic material cooperates with the internal and external magnetic materials so as to form a single layer; and a conductive pattern formed in the non-magnetic material so as to surround the internal magnetic material a plurality of times, wherein the internal magnetic material and the external magnetic materials opposed to the opposite lateral sides of the internal magnetic material form a magnetic path, along which magnetic fluxes of the magnetic field produced by current flowing along the conductive current flow, and a flow cross-section area for the magnetic fluxes in the internal magnetic material is equal to the sum of flow cross-section areas in the external magnetic materials.

The internal magnetic material is formed with internal projections at the opposite ends thereof, which project toward the external magnetic materials, respectively, and the external magnetic materials are formed with external projections, which project toward the internal magnetic material, at the middle areas of lateral sides thereof opposed to the internal magnetic material.

At least one of the external magnetic materials is formed with a magnetic material gap with a predetermined width in a magnetic flux advancement direction.

The magnetic material gap is formed between the external magnetic material and the bottom magnetic material, or between the external magnetic materials and the top magnetic material.

The opposite ends of each of the external magnetic materials extend to be flush with or beyond the opposite ends of the internal magnetic material, and if the opposite ends of each of the external magnetic materials extend beyond the opposite ends of the internal magnetic material, the opposite ends of each of the external magnetic materials extend to be flush with the opposite ends of each of the top and bottom magnetic materials.

The conductive pattern is formed by interconnecting conductive patterns, each provided in one of a plurality of layers of magnetic and non-magnetic materials, which are provided for fabricating the inductor in such a manner that a conductive pattern formed on one layer is connected to another conductive pattern formed on another layer just adjacent to the one layer, thereby forming a single conductive pattern for the inductor, the opposite ends of the conductive pattern of the inductor are electrically connected to the outside through the external terminals, respectively.

The flow cross-section area for magnetic flux in each of the top and bottom magnetic material is equal to the sum of the flow cross-section areas in the external magnetic materials.

In accordance with another embodiment, the chip-type inductor comprises, a magnetic material body comprising an internal magnetic material, external magnetic materials arranged to be opposed to the opposite lateral sides of the internal magnetic material with a predetermined space, and bottom and top magnetic material provided at the top and bottom surfaces of the internal and external magnetic materials to be connected with the internal and external magnetic materials; a non-magnetic material filling the space between the internal and external magnetic materials so as to cooperate with the internal and external magnetic materials, thereby forming a single plane; a conductive pattern formed in the non-magnetic material and extending around the internal magnetic material in a spiral form, the opposite ends of the conductive pattern being electrically connected to the outside, respectively; and external terminals electrically connected with the opposite ends of the conductive pattern, the external terminals being formed to cover the opposite ends of the integrated magnetic and the non-magnetic materials so as to implement the electrical connection to the outside, wherein the internal magnetic material is formed with internal projections at the opposite ends thereof, which project toward the external magnetic materials, respectively, and the external magnetic materials are formed with external projections, which project toward the internal magnetic area, at the middle areas of lateral sides thereof opposed to the internal magnetic material, and wherein the internal magnetic material and the external magnetic materials opposed to the opposite lateral sides of the internal magnetic material form a magnetic path, along which magnetic fluxes of the magnetic field produced current flowing along the conductive pattern flow, and a flow cross-section area for the magnetic fluxes in the internal magnetic material is equal to the sum of flow cross-section areas in the external magnetic materials.

The flow cross-section area of one of the external magnetic areas is equal to the flow cross-section area of the flow cross-section area of each of the top and bottom magnetic materials.

At least one side of the external magnetic materials has a magnetic material gap with a predetermined width in a magnetic flux advancement direction, the magnetic material gap being formed between the external magnetic material and the bottom magnetic material or between the external magnetic materials and the top magnetic material.

The opposite ends of each of the external magnetic materials extend to be flush with or beyond the opposite ends of the internal magnetic material and if the opposite ends of each of the external magnetic materials extend beyond the opposite ends of the internal magnetic material, the opposite ends of each of the external magnetic materials extend to be flush with the opposite ends of each of the top and bottom magnetic materials.

In accordance with another embodiment, the chip-type inductor comprising an internal magnetic material, external magnetic materials arranged to be opposed to the opposite lateral sides of the internal magnetic material, respectively, and a conductive pattern extending along a space formed between the internal magnetic material and the external materials, thereby surrounding the internal magnetic material so that magnetic fluxes of the magnetic field produced by current flowing along the conductive pattern flow through the internal magnetic material and the external magnetic materials, wherein a flow cross-section area for magnetic fluxes in the internal magnetic material is equal to the sum of flow cross-section areas for magnetic fluxes in the external magnetic materials.

The internal magnetic material is formed with internal projections at the opposite ends thereof, which project toward the external magnetic mates, respectively, and the external magnetic materials are formed with external projections, which project toward the internal magnetic material, at the middle areas of the lateral sides thereof opposed to the internal magnetic material whereby a space is uniformly formed between the internal magnetic material and the external magnetic materials, which have the internal projections and the external projections, respectively.

The opposite ends of each of the external magnetic materials extend to be flush with or beyond the opposite ends of the internal magnetic material.

At least one side of the external magnetic materials is formed with a magnetic material gap with a predetermined width in a magnetic flux advancement direction.

The chip-type inductor further comprising top and bottom magnetic materials connected to the top and bottom surfaces of the internal and external magnetic materials, wherein the flow cross-section area in each of the top and bottom magnetic materials is equal to that in one of the external magnetic materials.

In accordance with another embodiment, the chip-type inductor comprising, a magnetic material body comprising an internal magnetic material external magnetic materials arranged to be opposed to the opposite lateral sides of the internal magnetic material with a predetermined space, and bottom and top magnetic material provided at the top and bottom surfaces of the internal and external magnetic materials to be connected with the internal and external magnetic materials; a non-magnetic material filling the space between the internal and external magnetic materials so as to cooperate with the internal and external magnetic materials, thereby forming a single plane; and a conductive pattern formed on the non-magnetic material to extend spirally, thereby surrounding the edges of the internal magnetic material wherein a magnetic material gap is formed in at least one side of the external magnetic materials so as to prevent the saturation of magnetic fluxes flowing through the external magnetic materials.

The magnetic material gap is provided by forming at one or more layers of the external magnetic materials or at least a part of one layer of the external magnetic materials from a non-magnetic material.

The magnetic material gap is provided at a position where the external magnetic materials are connected to the top or bottom magnetic material.

The magnetic material gap is formed on the entirety of any one layer of the external magnetic materials.

The flow cross-section area for magnetic fluxes in the internal magnetic material is formed in a rectangular shape, and the external magnetic materials are formed to surround the internal magnetic material and wherein a flow cross-section area in the internal magnetic material and the sum of flow cross-section areas in the external magnetic materials are equal to each other.

In accordance with another embodiment, there is provided a chip-type inductor comprising a magnetic material body comprising an internal magnetic material an external magnetic materials arranged to surround the internal magnetic material with a predetermined space, and bottom and top magnetic material provided at the top and bottom surfaces of the internal and external magnetic materials to be connected with the internal and external magnetic materials; a non-magnetic material filling the space between the internal and external magnetic materials so as to cooperate with the internal and external magnetic materials, thereby forming a single plane; a conductive pattern formed in the non-magnetic material and extending around the internal magnetic material in a spiral form, the opposite ends of the conductive pattern being electrically connected to the outside, respectively; and external terminals electrically connected with the opposite ends of the conductive pattern, the external terminals being formed to cover the opposite ends of the integrated magnetic and non-magnetic materials so as to implement the electrical connection to the outside, wherein a magnetic material gap is formed in at least a side of the external magnetic material so as to prevent the magnetic fluxes flowing along the external magnetic material from being saturated, and wherein the internal magnetic material, the external magnetic material, and the top and bottom magnetic materials form a magnetic path, along which the magnetic fluxes of the magnetic field produced by current flowing along the conductive pattern flow, and a flow cross-section area for the magnetic fluxes in the internal magnetic material, a flow cross-section area in the external magnetic material, and a flow cross-section area in each of the top and bottom magnetic materials are equal to each other.

The magnetic material gap is provided by forming at least one of the layers of the external magnetic material from a non-magnetic material.

The magnetic material gap is formed at an area where the external magnetic material is connected with the top or bottom magnetic material.

The magnetic material gap is formed in the entirety of any one of the layers of the external magnetic material.

The magnetic material gap is filled with a non-magnetic material.

Any reference in this specification to "one embodiment," "an exemplary," "example embodiment," "certain embodiment," "alternative embodiment," and the like means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A chip-type inductor, comprising:

a magnetic material body including an internal magnetic material, external magnetic materials arranged to be opposed to the opposite lateral sides of the internal magnetic material with a predetermined space, and bottom and top magnetic material provided at the top and bottom surfaces of the internal and external magnetic materials to be connected with the internal and external magnetic materials;

a non-magnetic material filling the space between the internal and external magnetic materials in such a manner that the non-magnetic material cooperates with the internal and external magnetic material to form a single layer; and a conductive pattern formed in the non-magnetic material so as to surround the internal magnetic material a plurality of times, wherein, in the magnetic material body, the internal magnetic material and the external magnetic materials are opposed to the opposite lateral sides of the internal magnetic material form a magnetic path, along which magnetic flux of the magnetic field produced by current flowing along the conductive current flows, and a flow cross-section area for the magnetic flux in the internal magnetic material is at least substantially equal to a sum of flow cross-section areas in the external magnetic materials, wherein the flow cross-section area for magnetic flux in each of the top and bottom magnetic material is substantially equal to a sum of the flow cross-section areas in the external magnetic materials, wherein the internal magnetic material is formed with internal projections at opposite ends thereof, the internal projections respectively projecting toward the external magnetic materials, wherein the external magnetic materials are formed with external projections that project toward the internal magnetic material, the external projections located at middle areas of lateral sides of the external magnetic materials at areas that are opposed to the internal magnetic material, and wherein the flow cross-section area for magnetic fluxes in the internal magnetic material is formed in substantially an "I" shape.

2. The chip-type inductor of claim 1, wherein at least one of the external magnetic materials is formed with a magnetic material gap with a predetermined width in a magnetic flux advancement direction.

3. The chip-type inductor of claim 2, wherein the magnetic material gap is formed between the external magnetic material and the bottom magnetic material, or between the external magnetic materials and the top magnetic material.

4. The chip-type inductor of claim 1, wherein the opposite ends of each of the external magnetic materials extend to be flush with or beyond the opposite ends of the internal magnetic material and if the opposite ends of each of the external magnetic materials extend beyond the opposite ends of the internal magnetic material, the opposite ends of each of the external magnetic materials extend to be flush with the opposite ends of each of the top and bottom magnetic materials.

5. The chip-type inductor of claim 1, wherein the conductive pattern is formed by interconnecting conductive patterns, each provided in one of a plurality of layers of magnetic and non-magnetic materials, which are provided for fabricating the inductor in such a manner that a conductive pattern formed on one layer is connected to another conductive pattern formed on another layer just adjacent to the one layer, thereby forming a single conductive pattern for the inductor, the opposite ends of the conductive pattern of the inductor are electrically connected to the outside through the external terminals, respectively.

6. A chip-type inductor comprising:

a magnetic material body including an internal magnetic material, external magnetic materials arranged to be opposed to the opposite lateral sides of the internal magnetic material with a predetermined space, and bottom and top magnetic material provided at the top and bottom surfaces of the internal and external magnetic materials to be connected with the internal and external magnetic materials;

a non-magnetic material filling the space between the internal and external magnetic materials so as to cooperate with the internal and external magnetic materials, thereby forming a single plane;

a conductive pattern formed in the non-magnetic material and extending around the internal magnetic material in a spiral form, the opposite ends of the conductive pattern being electrically connected to the outside, respectively; and external terminals electrically connected with the opposite ends of the conductive pattern, the external terminals being formed to cover the opposite ends of the integrated magnetic and the non-magnetic materials so as to implement the electrical connection to the outside, wherein, in the magnetic material body, the internal magnetic material is formed with internal projections at the opposite ends thereof, which project toward the external magnetic materials, respectively, and the external magnetic materials are formed with external projections, which project toward the internal magnetic area, at the middle areas of lateral sides thereof opposed to the internal magnetic material, wherein the flow cross-section area for magnetic fluxes in the internal magnetic material is formed in substantially an "I" shape, wherein the internal magnetic material and the external magnetic materials opposed to the opposite lateral sides of the internal magnetic material form a magnetic path, along which magnetic flux of the magnetic field produced current flowing along the conductive pattern flow, and a flow cross-section area for the magnetic fluxes in the internal magnetic material is at least substantially equal to a sum of flow cross-section areas in the external magnetic materials, and wherein the flow cross-section area of one of the external magnetic areas is substantially equal to the flow cross-section area of the flow cross-section area of each of the top and bottom magnetic materials.

7. The chip-type inductor of claim 6, wherein at least one side of the external magnetic materials has a magnetic material gap with a predetermined width in a magnetic flux advancement direction, the magnetic material gap being formed between the external magnetic material and the bottom magnetic material or between the external magnetic materials and the top magnetic material.

8. The chip-type inductor of claim 6, wherein the opposite ends of each of the external magnetic materials extend to be flush with or beyond the opposite ends of the internal magnetic material, and if the opposite ends of each of the external magnetic materials extend beyond the opposite ends of the internal magnetic material, the opposite ends of each of the external magnetic materials extend to be flush with the opposite ends of each of the top and bottom magnetic materials.

9. A chip-type inductor comprising:

an internal magnetic material, external magnetic materials arranged to be opposed to the opposite lateral sides of the internal magnetic material, respectively, and a conductive pattern extending along a space formed between the internal magnetic material and the external materials, thereby surrounding the internal magnetic material, wherein magnetic flux of the magnetic field produced by current flowing along the conductive pattern flow through the internal magnetic material and the external magnetic materials, wherein a flow cross-section area for magnetic flux in the internal magnetic material is at least substantially equal to a sum of flow cross-section areas for magnetic flux in the external magnetic materials, and wherein the internal magnetic material is formed with internal projections at the opposite ends thereof, which project toward the external magnetic materials, respectively, and the external magnetic materials are formed with external projections, which project toward the internal magnetic material, at middles areas of the lateral sides thereof opposed to the internal magnetic material, wherein a space is uniformly formed between the internal magnetic material and the external magnetic materials, which have the internal projections and the external projections, respectively, and wherein the flow cross-section area for magnetic fluxes in the internal magnetic material is formed in substantially an "I" shape.

10. The chip-type inductor of claim 9, wherein the opposite ends of each of the external magnetic materials extend to be flush with or beyond the opposite ends of the internal magnetic material.

11. The chip-type inductor of claim 10, wherein at least one side of the external magnetic materials is formed with a magnetic material gap with a predetermined width in a magnetic flux advancement direction.

12. The chip-type inductor of claim 11, further comprising top and bottom magnetic materials connected to the top and bottom surfaces of the internal and external magnetic materials, wherein the flow cross-section area in each of the top and bottom magnetic materials is equal to that in one of the external magnetic materials.

13. A chip-type inductor comprising:

a magnetic material body including an internal magnetic material, external magnetic materials arranged to be opposed to the opposite lateral sides of the internal magnetic material with a predetermined space, and bottom and top magnetic material provided at the top and bottom surfaces of the internal and external magnetic materials to be connected with the internal and external magnetic materials;

a non-magnetic material filling the space between the internal and external magnetic materials so as to cooperate with the internal and external magnetic materials, thereby forming a single plane; and a conductive pattern formed on the non-magnetic material to extend spirally, thereby surrounding the edges of the internal magnetic material, wherein a magnetic material gap is formed in at least one side of the external magnetic materials so as to prevent the saturation of magnetic flux flowing through the external magnetic materials, wherein the flow cross-section area for magnetic fluxes in the internal magnetic material is formed in substantially a rectangular shape, and the external magnetic materials are formed to surround the internal magnetic material, and wherein a flow cross-section area in the internal magnetic material and a sum of flow cross-section areas in the external magnetic materials are substantially equal to each other.

14. The chip-type inductor of claim 13, wherein the magnetic material gap is provided by forming at one or more layers of the external magnetic materials or at least a part of one layer of the external magnetic materials from a non-magnetic material.

15. The chip-type inductor of claim 13, wherein the magnetic material gap is provided at a position where the external magnetic materials are connected to the top or bottom magnetic material.

16. The chip-type inductor of claim 13, wherein the magnetic material gap is formed on the entirety of any one layer of the external magnetic materials.

17. A chip-type inductor comprising:

a magnetic material body including an internal magnetic material, an external magnetic materials arranged to surround the internal magnetic material with a predetermined space, and bottom and top magnetic material provided at the top and bottom surfaces of the internal and external magnetic materials to be connected with the internal and external magnetic materials;

a non-magnetic material filing the space between the internal and external magnetic materials so as to cooperate with the internal and external magnetic materials, thereby forming a single plane;

a conductive pattern formed in the non-magnetic material and extending around the internal magnetic material in a spiral form, the opposite ends of the conductive pattern being electrically connected to the outside, respectively; and external terminals electrically connected with the opposite ends of the conductive pattern, the external terminals being formed to cover the opposite ends of the integrated magnetic and non-magnetic materials so as to implement the electrical connection to the outside, wherein a magnetic material gap is formed in at least a side of the external magnetic material so as to prevent the magnetic flux flowing along the external magnetic material from being saturated, wherein the internal magnetic material the external magnetic material, and the top and bottom magnetic materials form a magnetic path, along which the magnetic flux of the magnetic field produced by current flowing along the conductive pattern flow, and a flow cross-section area for the magnetic flux in the internal magnetic material, a flow cross-section area in the external magnetic material, and a flow cross-section area in each of the top and bottom magnetic materials are at least substantially equal to each other, and wherein the flow cross-section area for magnetic fluxes in the internal magnetic material is formed in substantially a rectangular shape.

18. The chip-type inductor of claim 17, wherein the magnetic material gap is provided by forming at least one of the layers of the external magnetic material from a non-magnetic material.

19. The chip-type inductor of claim 18, wherein the magnetic material gap is formed at an area where the external magnetic material is connected with the top or bottom magnetic material.

20. The chip-type inductor of claim 19, wherein the magnetic material gap is formed in the entirety of any one of the layers of the external magnetic material.

21. The chip-type inductor of claim 20, wherein the magnetic material gap is filled with a non-magnetic material.

* * * * *